US005464331A

United States Patent [19]

Sawyer

[11] Patent Number: 5,464,331

[45] Date of Patent: Nov. 7, 1995

[54] ENGINE AND POWER OUTPUT

[76] Inventor: James K. Sawyer, 10311 Sagecourt Dr., Houston, Tex. 77089-5601

[21] Appl. No.: 149,229

[22] Filed: Nov. 9, 1993

[51] Int. Cl.[6] ..... F04B 17/05

[52] U.S. Cl. ..... 417/364

[58] Field of Search ..... 417/364, 34

[56] References Cited

U.S. PATENT DOCUMENTS

| | | | |
|---|---|---|---|
| 27,426 | 3/1860 | Brown | 417/404 |
| 138,622 | 5/1873 | Eickemeyer | 417/316 |
| 766,237 | 8/1904 | Frisbie | 417/404 |
| 2,674,401 | 4/1954 | Mallory | 417/364 |
| 3,208,439 | 9/1965 | Ulbing | 417/364 |
| 3,414,187 | 12/1968 | McMullin et al. | 417/364 |
| 3,986,796 | 10/1976 | Muiroux et al. | 417/364 |
| 4,115,037 | 9/1978 | Butler | 417/364 |
| 4,362,477 | 12/1982 | Patten | 417/364 |
| 4,369,021 | 1/1983 | Heintz | 417/364 |
| 4,415,313 | 11/1983 | Bouthers | 417/364 |
| 4,705,460 | 11/1987 | Braun | 417/364 |
| 4,776,166 | 10/1988 | Dixon | 417/364 |
| 4,841,921 | 6/1989 | Yang | 417/364 |
| 4,992,031 | 2/1991 | Sampo | 417/364 |

*Primary Examiner*—Richard A. Bertsch
*Assistant Examiner*—Peter G. Korytnyk
*Attorney, Agent, or Firm*—Gunn & Associates

[57] ABSTRACT

The present disclosure sets forth an improved engine and power output having an in-line powered end and pump end. The powered end incorporates a piston in a cylinder while the pump end also has a piston in a cylinder. A straight rod is connected between the powered end and the pump end so that axial reciprocating motion is created between the powered end and the pump end. The axial motion imparted to the straight rod by the powered end operates the pump end piston and creates axial reciprocating motion, thus eliminating intervening moving parts. A crankcase is included between the powered end and the pump end for enclosing and lubricating the moving components. The powered end preferably comprises a portion of an internal combustion engine.

18 Claims, 7 Drawing Sheets

ENGINE AND POWER OUTPUT

The present invention relates to an improved means for imparting power to a pump. One feature of this improved pump and engine avoids many problems of the prior art by avoiding rotational movement of the main power rod connected from a power piston of an internal combustion engine to a piston pump. The power unit imparts direct axial movement to the piston pump and reduces the typical parts associated with rotational movement in reciprocating engines.

BRIEF DESCRIPTION AND BACKGROUND

In the industrial revolution, early power units were steam engines. Steam engines typically then used a cylinder and a piston confined to axial movement with a rod connected to a wrist pin which allowed the power rod to impart rotational movement to a shaft or axle. This basic structure can be recalled most notably in steam locomotive engines. As engines grew in complexity, multiple cylinders in the same engines delivered their respective power strokes to a rotating crankshaft. At the end of the rotating crankshaft, sprockets or gears were affixed that further imparted rotational energy to other units by means of drive shafts, chains, or belts. The driven units receiving this reciprocating motion typically included gear reduction units, hydraulic pumps, and additional crankshafts. These various connections and parts resulted in (1) inefficiency, (2) complexity, (3) additional maintenance, and (4) increased weight. Every bearing in every connection results in loss of efficiency. For instance, chain drives from sprockets are considered very efficient with an efficiency of approximately 95%. Drive shafts operating through gears have an efficiency in the range of 80% to 85%. The typical losses of efficiency are multiplied at every connection, every sprocket, every separate chain, and every gear. As the connections increase, the loss in efficiency and power can be substantial. This loss in efficiency is power that is dissipated and not available as useful energy. Secondly, the additional parts result in complexities of design and increased maintenance. Every bearing, sprocket, chain, etc. requires lubrication, periodic service or replacement and movement coordination with the various parts. This in turn results in increased cost. Additionally, the complexities and extra parts add extra weight. These considerations result in further increased inefficiencies and places a limiting factor upon applications where weight is a significant consideration, such as light power units used in aircraft, automobiles, and portable installations.

Regarding references in the art, the patent of Brown, U.S. Pat. No. 27,426, is a very old steam pump mechanism defining a double acting piston. Understanding of the Brown mechanism, it operates with a straight rod which in turn connects with an articulated joint which in turn connects with a heart piece at mid portions. The linear stroke is converted into rotary motion by the frame along an eccentric rod. The construction is unsuitable for high speed operation.

Another patent is Frisbie, U.S. Pat. No. 766,237, which shows a similar construction to the Brown patent. It contains a direct linkage from the pump cylinder to the valve chest for controlling the supply of steam. Since the direct linkage axially moves left and right, an attached linkage turns a crank connected to a fly wheel. It solely depends upon steam power, which is less responsive in part because the steam cylinder depends upon another power source to produce the steam to move the piston. Axial movement of the piston is inherent and typical of steam cylinder movement. Rotational movement of a steam powered crankshaft is a virtue in Frisbie, but it is a drawback for modern combustion engines and is avoided by the present invention. This attribute of the present invention enables improved efficiency and weight reduction.

The patent of Eickemeyer, U.S. Pat. No. 138,622, is similar to the Frisbie in major aspects. It also contains a direct linkage from the power source to the pump with an attachment, has axial movement, and imparts rotational movement to a fly wheel.

The Mallary patent, U.S. Pat. No. 2,674,401, shows an internal combustion engine with a compressor. However, it does not use direct acting linkage, but instead it depends on a power rod rotating about a crankshaft which imparts rotational movement to a timing mechanism and causes the pump rod to move in a radial or rocking motion. One disadvantage of the Mallary mechanism compared to the present invention is that the forces from the power stroke and return stroke cause unnecessary and excessive forces acting on the crankshaft. These forces have to be counteracted by heavier bearings, increased maintenance on the bearing with increased lubrication, and stronger materials to carry the torsional forces. The present invention eliminates rotational or rocking motion of the main power rod. The main power rod movement is directly linked between the power piston and the pump piston. Therefore, higher stresses from combined torsion and compressive or tensile stresses are eliminated. This allows lighter weight or even composite material construction of the main power rod. The rotational movement of selected components of the present invention is simply to perform ancillary functions, i.e., timing and coordination of the various assemblies, restriction of the stroke, and provide a convenient input from a starter, or to drive an oil pump, if necessary. However, the main forces are coupled primarily through the axial movement of the power rod without rotation. Indeed, the power rod can be fixedly coupled at both ends without bearings or wrist pin.

BRIEF SUMMARY OF THE DISCLOSED APPARATUS

This disclosure sets forth a power piston connected with a rod which connects to a pump piston at the opposite end of the rod. Conveniently, the rod can be rigidly or fixedly connected to both the power piston and the pump piston. Power from the power piston is delivered through the rod without rotation of the rod. The rod reciprocates to and fro in response to power from the piston which incorporates a cylinder surrounding the piston and suitable intake and outlet valves for operation of an internal combustion engine. Moreover, multiple units can be coupled to provide more volume or pressure or both. By eliminating wrist pins and bearing assemblies, the power transfer is simplified. While the foregoing describes only linear motion reciprocating the piston rod, the power end incorporates valves in a cylinder head to provide a two stroke engine or four stroke engine.

DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
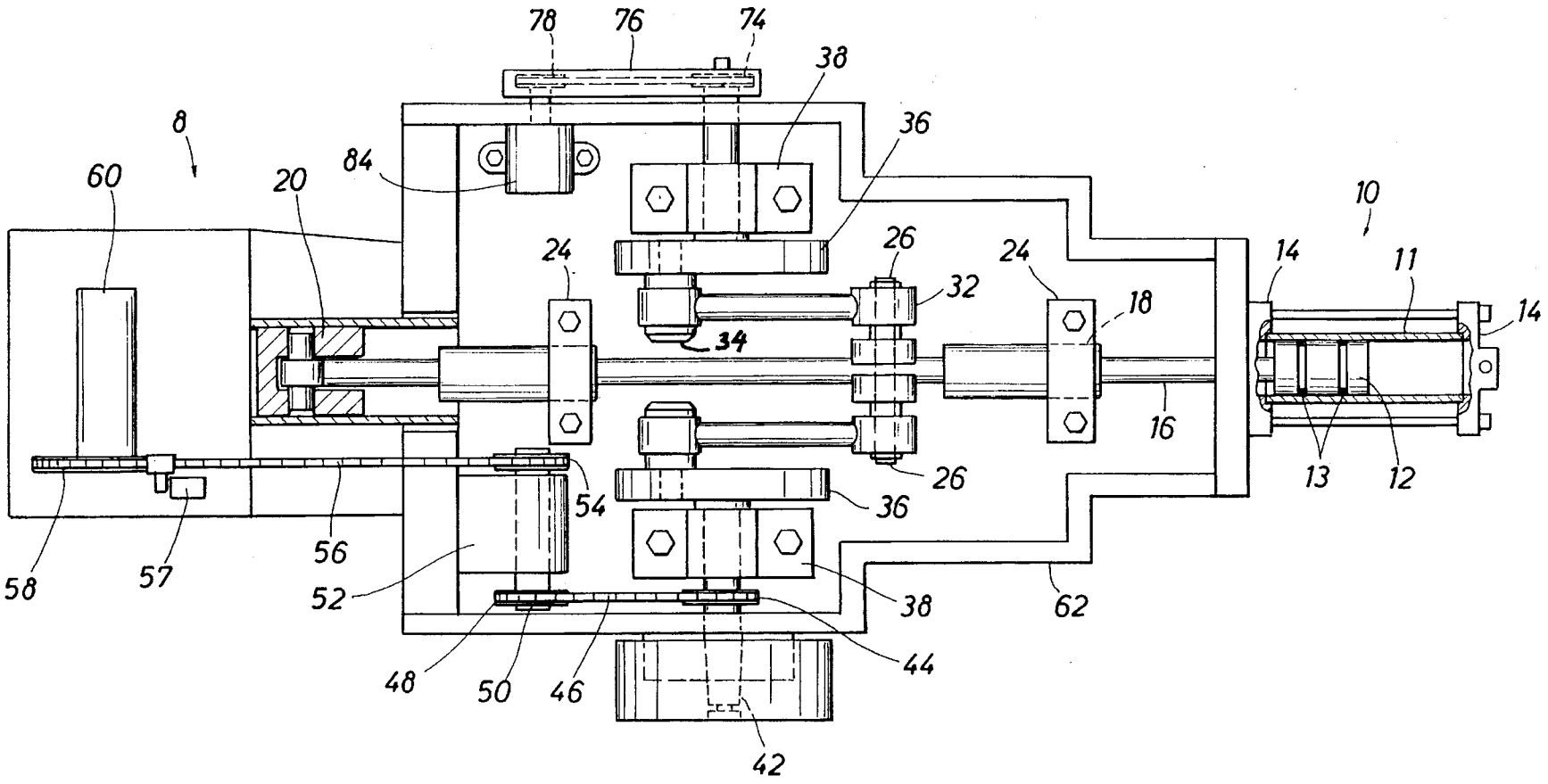
FIG. 1 of the drawings is a plan view of the structure of the present disclosure which shows a crankcase open at the top to reveal moving components and further showing a power piston in a cylinder to the left and a pump piston in a cylinder to the right which are connected together by a straight rod between the two pistons.

Going first to FIG. 1, the preferred embodiment is constructed of three primary components which are the power unit 8, the pump unit 10 at the fight, and the associated power transfer system between the cooperative power unit 8 and pump 10. The power unit 8 is typically an internal combustion engine. The preferred embodiment of FIG. 1 is a single cylinder, four stroke engine having synchronized valves as will be described. However, there is no limitation to the number of cylinders that can be ganged together. Furthermore, the power unit engine can be a two stroke engine with appropriate power strokes on every stroke to the right by the piston. The pump 10 is a hydraulic cylinder and piston pump and can vary in stroke, diameter, and pressure rating. The pump 10 in this embodiment is a single acting, or double acting pump, if pumping on both strokes is desired. Generally, the pump 10 may be used for hydraulic or fluid materials which are compressible substances. The transfer mechanism includes a power rod 16 (formed of one or plural segments) moving essentially in a straight line from the power piston 20 to the pump piston 12. This power rod 16 is essentially a straight connecting rod to impart a 1:1 motion ratio from the power piston 20 to the pump piston 12. There are no gears, sprockets, crankshafts or other intermediate transfer mechanisms between the engine 8 and pump 10 to reduce power and efficiency or cause excessive maintenance or contribute weight increases. Herein lies one virtue of this invention.

More specifically, the power unit 8 of FIG. 1 is preferably a single cylinder, four stroke engine that includes typical components such as valves, springs, cam lifters, camshaft, timing chain, cylinder head, cylinder wall, piston, piston sealing rings, and known parts of an internal combustion engine. It can be water cooled or air cooled. The engine can be carburated or fuel injected, and it is powered by gasoline, natural gas, diesel, alcohol or any other combustible fuel. However, the present invention essentially eliminates the lower portions of an engine which include (among other things) the crankshaft and rods connected to the crankshaft, associated bearings, drive sprockets and pulleys that typically transmit the power.

Figure 2:
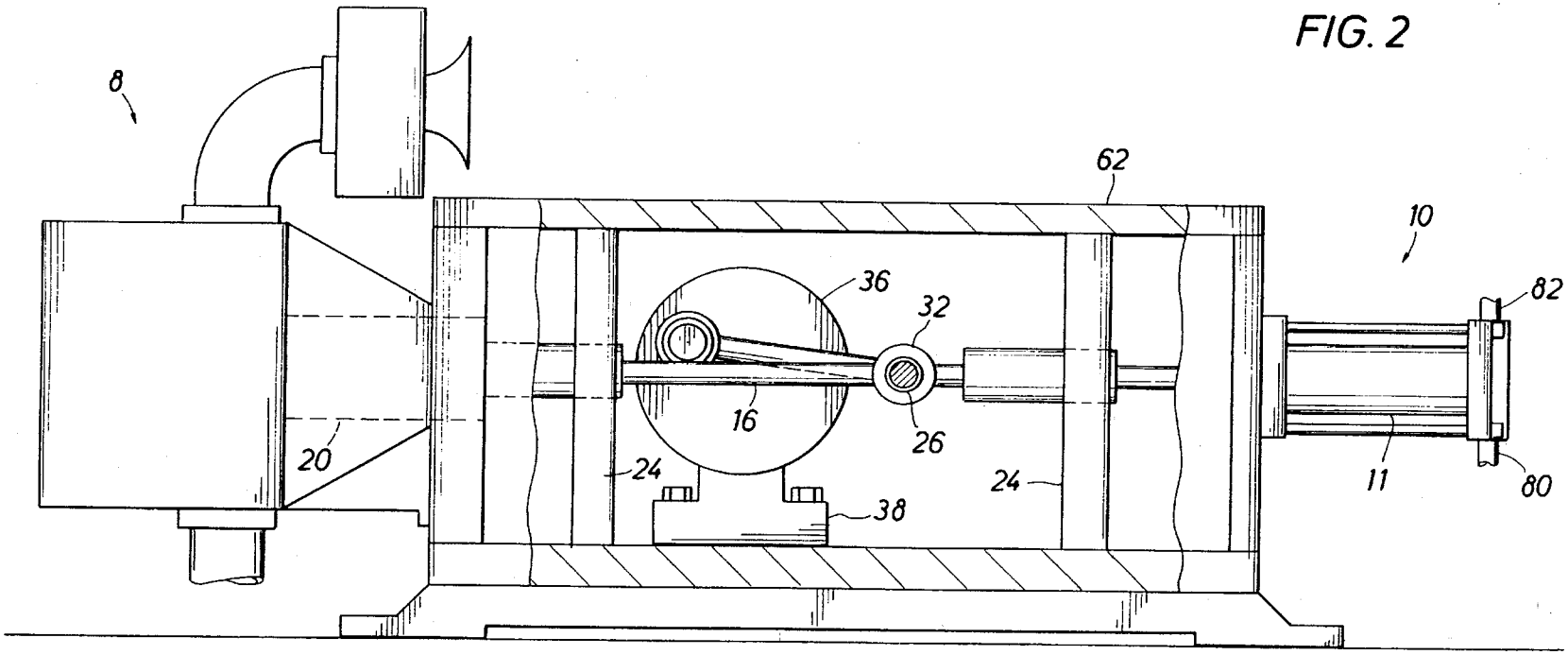
FIG. 2 of the drawings is a side view of the structure shown in FIG. 1 of the drawings wherein the side view shows the crankcase with the power piston at the left end and the pump piston at the right end and further showing details of construction of the crankcase and various components.

The pump 10 includes the cylinder 11, a reciprocating piston 12, one or more sealing rings 13 around the piston, the power rod 16 connected to the piston 12, spaced cylinder heads 14 on the cylinder, and an inlet port 80 and outlet port 82 (see FIG. 2). The preferred embodiment of the pump 10 handles fluids such as water or hydraulic fluid. The reciprocating movement directly from the power piston 20 may be used for compressing gases, various chemicals in a refinery, or a multitude of other applications where a reciprocating pump could be useful.

In FIG. 2, the pump is shown connected with suitable valves by flow lines to enable connection in a system such as a refrigeration cycle. One example will be given later involving a refrigerator system on a trailer to enable cooling of perishable cargo in a truck trailer. The pump 10 is powered by the small engine 8 of a few horsepower where the pump 10, operates as a compressor to enable hot refrigerant gases to be compressed in a closed loop recirculation system to cool liquid to reject heat and convert the cooled, compressed gas into a liquid in a manner believed to be well known. The pump 10 has a compression ratio determined by the cylinder size in conjunction with the stroke length. Therefore, a ratio of 5:1 or perhaps as high as 20:1 typically can be used to compress the refrigerant gas.

The power unit 8 drives the pump 10 with a straight, one piece or segmented power rod 16. The preferred embodiment rod 16 is a single elongate substantially straight centered rod connecting the power piston 20 and the pump piston 12 so that any movement of the piston 20 directly imparts the same amount of movement to the pump piston 12. This improves efficiency by avoiding intermediate connections such as gears, chain drives, vanes on torque converters, and drive shafts.

This directly linked power rod 16 connects to other components to complete the power system. The transfer unit is encased in a closed shell 62 containing oil or other lubricating liquids. The shell 62 is a closed housing having appropriate seal assemblies at any moving component. Internally, an oil bath is provided for moving parts on the interior of the shell to enable component movement. The shell 62 encloses and supports illustrated bearings, chains, shafts, and timing devices. The power rod 16 is connected to the pump piston 12 to span the full length of the shell 62. The power rod 16 is supported for axial movement by bearings 18 at two spaced locations supported by spaced pillow blocks 24. The bearings 18 are sometimes known as a linear bearing.

At the central portion of the power rod 16, a laterally extending wrist pin 26 connects to a connecting rod 32. While one end of the connecting rod 32 is reciprocated by the wrist pin 26, a stub shaft 34 connects to the other end. The stub shaft 34 connects to a flywheel 36. The flywheel 36 is rotated about a central support shaft 42 which is supported by a pillow block 38. As the power rod 16 moves axially or linearly, the wrist pin 26 also moves axially. This axial movement causes the flywheel 36 to rotate about the shaft 42. The momentum stored by the rotational movement of the flywheel 36 aids in the reciprocation of the power piston 20 of the power unit 8 and the pump piston 12 of the pump 10. This overcomes stalling at starting.

One important aspect of the presently described rotational components is that the primary power stroke is linear, not rotational. In particular, the power piston 20 moves to and fro in linear motion. This linear motion using the power rod 16 can handle power ends as small as desired and as large as practical, easily up to several hundred horsepower per cylinder. In that event, several hundred horsepower output is directed to the pump with modest power extracted via the rotary system to operate important auxiliary equipment such as oil lubrication pumps and the like.

The rotary system is preferably made in duplicate as exemplified by the two flywheels 36 arranged on opposite sides of the power rod 16. Duplicate parts bear identical numbers. This symmetry reduces vibration and assures better loading on the wrist pin 26. Furthermore, this rotation powers an oil pump 84, controls the timing of the camshaft 60, and powers an auxiliary external units connected to shafts 42. The preferred embodiment balances the rotational parts by duplicating the flywheels 36 and connecting rods and shafts as shown in FIG. 1.

A timing system is necessary to time firing of the internal combustion engine in sequence to power the axial movement of the power rod 16. The preferred embodiment envisions a sprocket or pulley 44 connected about the shaft 42 to drive a chain or toothed belt 46 engaging the sprocket 44 and a sprocket 48 on a jackshaft 50. This jackshaft 50 is supported by a pillow block 52. The remote end of the jackshaft 50 supports another sprocket or toothed pulley 54. The sprocket 54 engages a chain or toothed belt 56 connecting from the sprocket 54 to a sprocket 58 on the camshaft 60. A cam chain tensioner 57 keeps the chain or toothed belt 56 tight. The camshaft 60, in turn, controls the timing or the opening of the valves (FIG. 3) as is understood by those knowledgeable in the art of internal combustion engines. Other equipment included in the head portions of the internal combustion power unit 8 includes the springs, lifters, idler pulleys, chain tensioners, bearings, seals and gaskets need not be detailed herein.

The shaft 42 is connected to power an oil pump 84. This is done by attaching a sprocket or toothed pulley 74 to the shaft 42 to drive a chain or toothed belt 76 connected to a sprocket 78. The sprocket 78 is in turn attached to the shaft of oil pump 84. The preferred embodiment envisions an oil pump to inject or spray oil at various high wear areas throughout the crankcase area as needed. The auxiliary (rotary) functions are independent of the main and direct axial force applied to the power rod 16 from the power unit 8 to the pump 10.

Check valves (see FIG. 2) may be necessary in the pump 10 to control the inlet and outlet transfer of fluids. An exhaust check valve 82 controls the discharge of the hydraulic fluid or gas. An intake check valve 80 controls the suction flow of hydraulic fluid or gas.

An alternative embodiment retains essentially the same power unit 8 and the pump 10, but it omits the crankcase or shell 62. This alternate version envisions the use of sealed bearings at each reciprocating or sliding connection. By using sealed bearings, the crankcase or shell 62 which retains lubrication oil is omitted. By eliminating the shell 62, spacing between the pump 10 and the power unit 8 is free of the restraints resulting from shell lubrication. Spacing from the power unit 8 is important for access to remote locations such as explosive areas in factories or other specialized installations. Additionally, some applications may prefer to omit the shell or crankcase and its lubricating fluid. Furthermore, the oil pump 84 and accompanying hardware (described previously in the preferred embodiment) may be wholly omitted or retained for specific lubrication at selected wear points. With an extended power rod 16, additional bearings 18 and aligned pillow blocks 24 may be necessary to support the longer rod 16. Additionally, without a lubrication enclosing shell 62, and associated oil pump the power piston 20 may require ring lubrication from another source. Lubrication can be done in a number of ways. Oil for lubrication can be dripped or sprayed on the power piston 20 and cylinder walls at timed intervals. Lubrication can be accomplished by reducing a crankcase capacity to retain lubricating fluid only at the rod side of power unit 8. Lubrication also may be accomplished by mixing lubrication in the fuel as is done in typical two stroke engines. Material choice also reduces lubrication needs.

Figure 3:
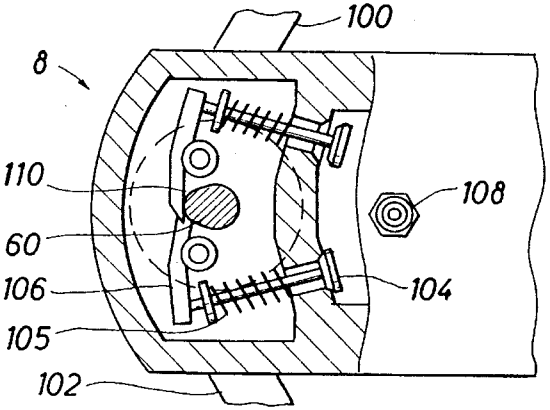
FIG. 3 of the drawings is a view showing a cam shaft for opening and closing inlet and outlet valves.

FIG. 3 shows in greater detail the power unit 8 which is a two valve, single cylinder, four stroke, internal combustion engine similar to those well known in the art of internal combustion engines. This head assembly has an inlet 100 for the entry of gasoline/air mixture. A spark plug 108 ignites the gas/air mixture. Valve opening is controlled by the camshaft 60 having eccentric lobes 110. The camshaft 60 coordinates the movement of the rocker arms 106 and valves 104 while valve closure is urged by the valve spring 105. Combustion gases escape through the exhaust 102.

Figure 4:
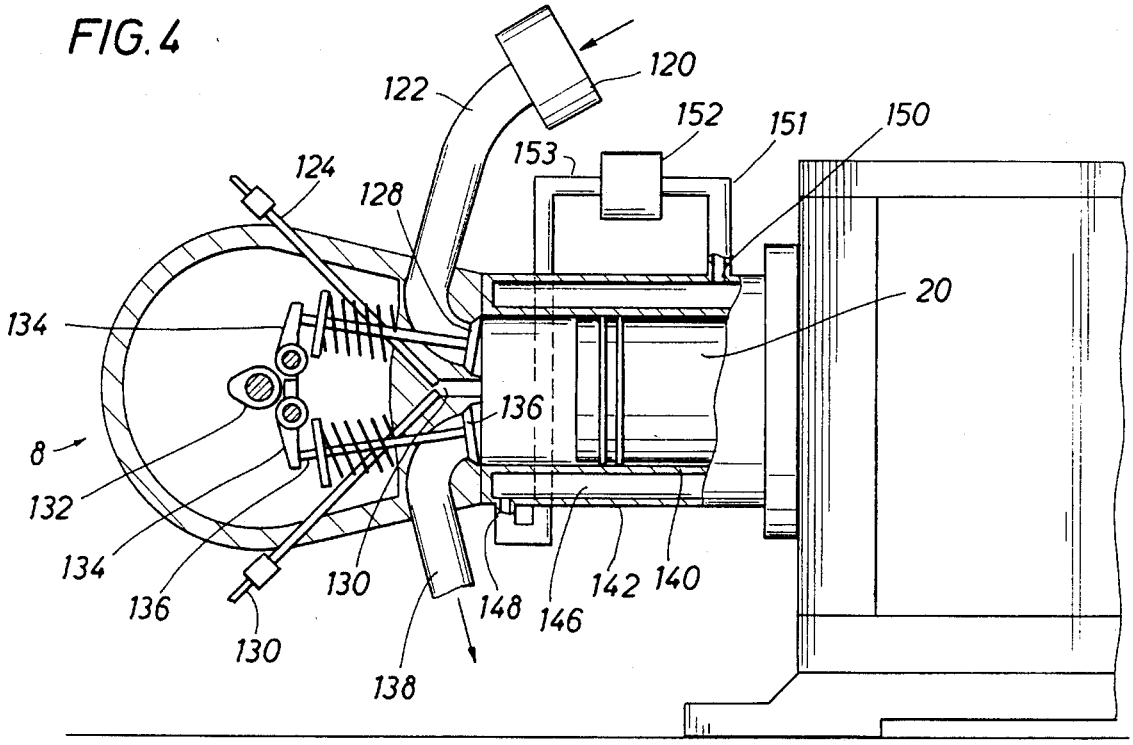
FIG. 4 is an alternate embodiment of the power unit having a diesel head assembly for a four stroke, single cylinder, water cooled engine.

FIG. 4 shows an alternative embodiment of power unit 8. It is a single cylinder, two valve, four stroke, diesel engine. Timing of the valves is similar to the embodiment illustrated in FIG. 3. Air enters through an air cleaning device 120 and continues through air intake conduit 122 to the combustion chamber. The combustion chamber in the cylinder is compressed by the power piston 20 which reciprocates to and fro. An intake valve 128 opens and closes in accordance with proper timing controlled by the camshaft to permit air to flow into the combustion chamber. Fuel is injected into the combustion cavity through a fuel injector 124. A glow plug 130, ignites the fuel/air mixture to start the engine but subsequent ignition is diesel initiated. Exhaust gases escape through an exhaust valve 136 and outlet 138. Opening and closing of the exhaust valve 136 and intake valve 128 are coordinated by movements of the camshaft 132 coupled through the rocker arms 134. Cooling is provided by a cooling chamber 146 defined by an internal cylinder wall 140 and a concentric cylinder wall 142. Coolant enters through flow inlet 148 and exits water flow outlet 150. The flowing hot water is cooled by a heat exchanger 152 and returns to a water inlet 148. The two concentric walls define the water jacket for cooling. Those having average skill in the art may provide an air cooling system.

Because the present invention incorporates a directly connected power rod 16, certain engine components are eliminated. This beneficially changes the power unit 8. These changes provide several advantages. For instance, in FIGS. 5–9 various embodiments of two stroke modified engines are shown. These two stroke engines are simplified as a corresponding result of the direct connection of the power rod 16 from the power piston 20 to the pump piston 12. These modified engines improve over the prior art in that the fuel does not need lubricating oil mixed with the fuel as many two stroke engines require, thus improving discharge effluent quality.

Figure 5:
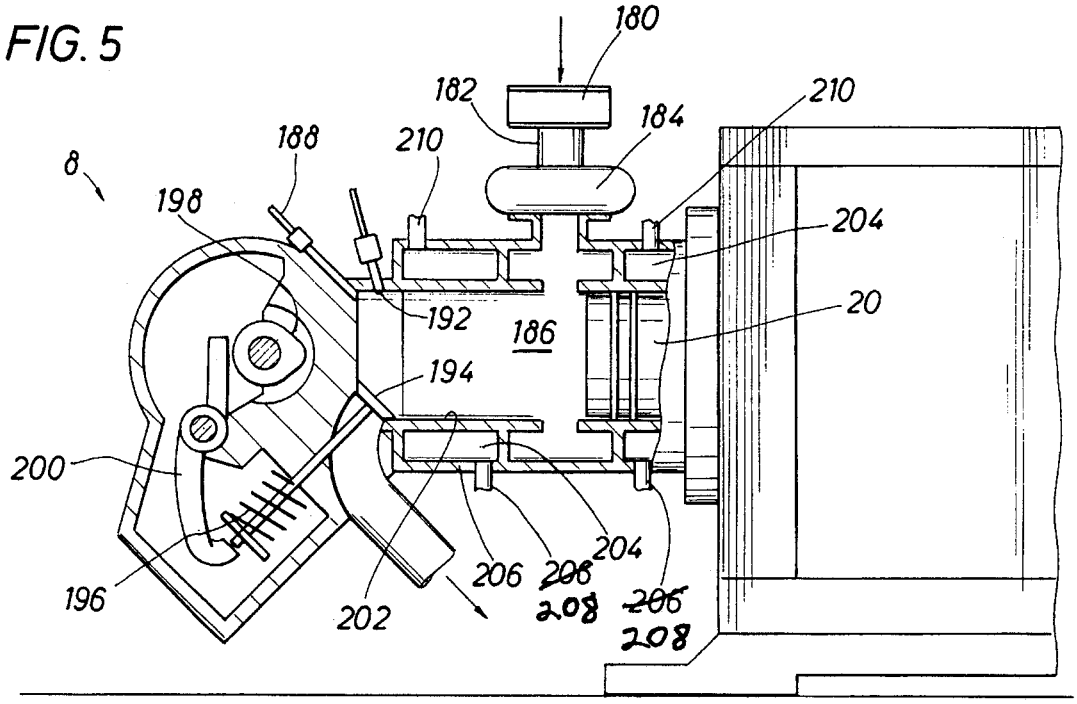
FIG. 5 shows another embodiment having a modified two stroke, diesel engine utilizing only the top end for intake, compression, power and exhaust while the lower end, opposite the combustion chamber, is fully lubricated.

Another embodiment of power unit 8 is shown in FIG. 5. This embodiment is a two stroke, single valve, single cylinder, diesel engine. This embodiment is similar to known two cycle engines in that the firing cycle steps of intake, compression, combustion, and exhaust still occur in the same sequence and fashion at the power piston 20. Air enters the power unit 8 through an air filter 180 passing through air inlet conduit 182 through air charging device 184 and into the combustion chamber 186. The air charging device 184 can be a supercharger or turbocharger (assuming the turbocharger is not needed during starting). By connecting the air inlet line into the chamber 186 at a location closed by piston movement, the intake valve is thus effectively eliminated. A fuel injector 188 directs fuel into chamber 186. The resulting mixture of fuel and air is ignited by diesel action while a glow plug 192 is included to start the device. Spent exhaust gases escape through an exhaust valve 194. Movement of the exhaust valve 194 is coordinated by action of spring 196 and exhaust cam 198 actuating a rocker arm 200.

In FIG. 5, engine cooling is accomplished by water flow in connected water jacket chambers 204 around the cylinder. The water jacket 204 is defined by a cylinder wall 202 and a spaced outer wall 206. Coolant enters through several coolant inlets 208 and exits through several coolant exhausts 210. The coolant then flows through a heat exchanger and returns as described in the embodiment of FIG. 4. Likewise, given sufficient cooling surfaces, lower operating or ambient temperatures, and heat exchange requirements, an air cooled power unit can be used. Omission of the inlet valve is dependent on sealing as the piston 20 seals against cylinder wall 202 as power piston 20 reciprocates to and fro in the combustion chamber 186.

The embodiment of FIG. 5, although a two stroke engine, does not require that the fuel be mixed with lubricating oil as a typical two stroke engine normally requires for lubrication. This embodiment differs from the typical two stroke engine in that combustion operations occur within the cylinder combustion chamber 186 while using a positive piston pressure. Prior art engines (such as two cycle, low horsepower engines) normally aspirate the cylinder by compressing the air in the crankcase. A lubrication system on the other side of power piston 20 typical of cleaner burning four stroke engines is obtained. Known two stroke engines normally involve the crankcase chamber in fuel gas/air compression. Because typical two stroke engines direct the fuel/air mixture into the crankcase area, lubrication cannot be provided splash or positive pressure in the crankcase by submersion in lubricants. Thus, the lubricating oil must be mixed with the fuel, and is combusted, resulting in increased discharge of pollutants. The present invention has freed the crankcase of this duty and avoided components such as crankshafts and rotating rods and bearings. The combustion chamber 186 is the only location for fuel/air combustion steps involving intake, compression, power, and exhaust. Because the lubrication similar to a well known four stroke engine with a wet crankcase lubrication system, the fuel is not mixed with lubrication oil as usually done in a typical two cycle engine. Therefore, combusted gas pollutants are significantly decreased.

Figure 6:
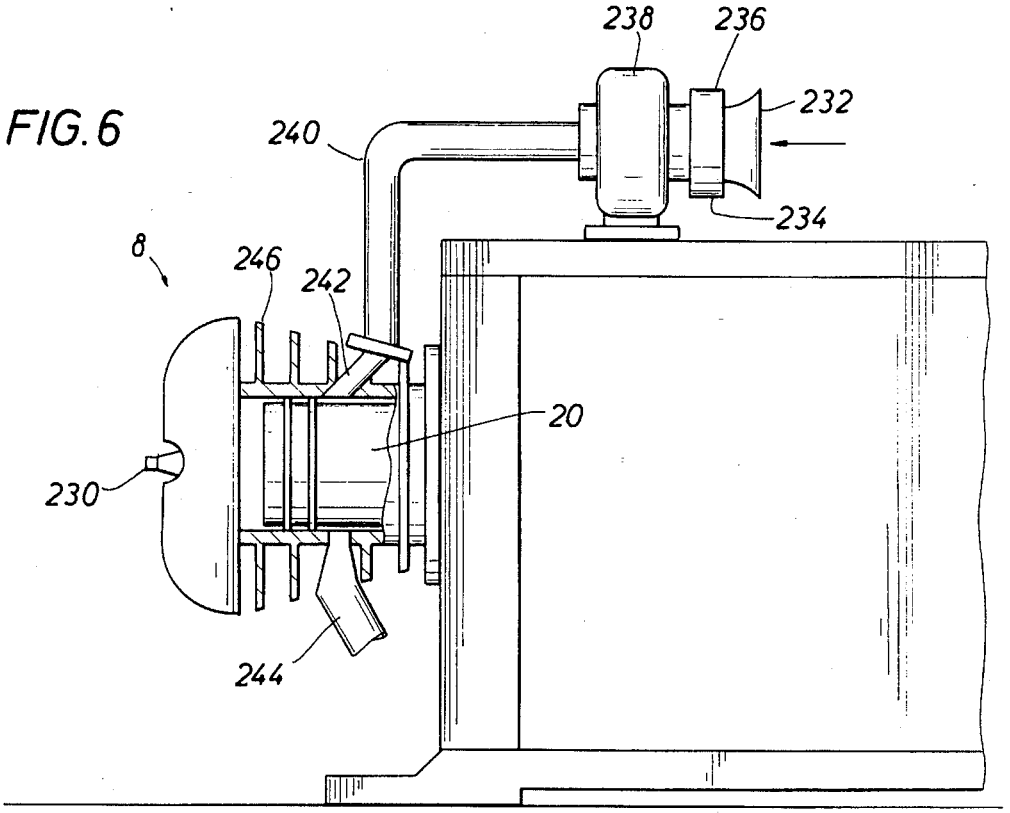
FIG. 6 is another embodiment of the power unit having a two stroke, gasoline powered engine with an air charging supercharger cooperative with a lubricated crankcase.

An alternative embodiment of FIG. 6 shows a variation of the power unit 8 illustrated in FIG. 5. This variation in FIG. 6 is a two stroke, gasoline powered engine. A spark plug 230 provides timed ignition. A fuel injection system or carburation system can be used. Air enters an inlet 232, passes through fuel mixing device 234 and a turbocharger (again, assuming no starting problems) or supercharger 238 providing a pressure boost of approximately 2 to 3 psi. The air then passes through a conduit 240 into the cylinder 242 where combustion occurs. As in FIG. 5, sealing is accomplished by the movement over the air inlet of power piston 20 reciprocating to and fro, eliminating the need for an intake valve. Exhaust gases exit through an exhaust port 244. Lubrication is accomplished through the use of a oiling system as described in FIG. 5. This type of lubrication is similar to the lubrication found commonly in four stroke, gasoline or diesel engines which do not need oil mixed with the fuel for cylinder lubrication.

As in the embodiment of FIG. 5, the embodiment in FIG. 6 uses a similar lubrication system which effectively eliminates the need for lubrication entrained with the fuel which thus reduces pollutants in the air. As an alternative to premixing the air and fuel in the fuel mixing device 234, a direct cylinder fuel injector can be used. Heat dissipating surfaces 246, known as fins, air cool the power unit 8.

Figure 7:
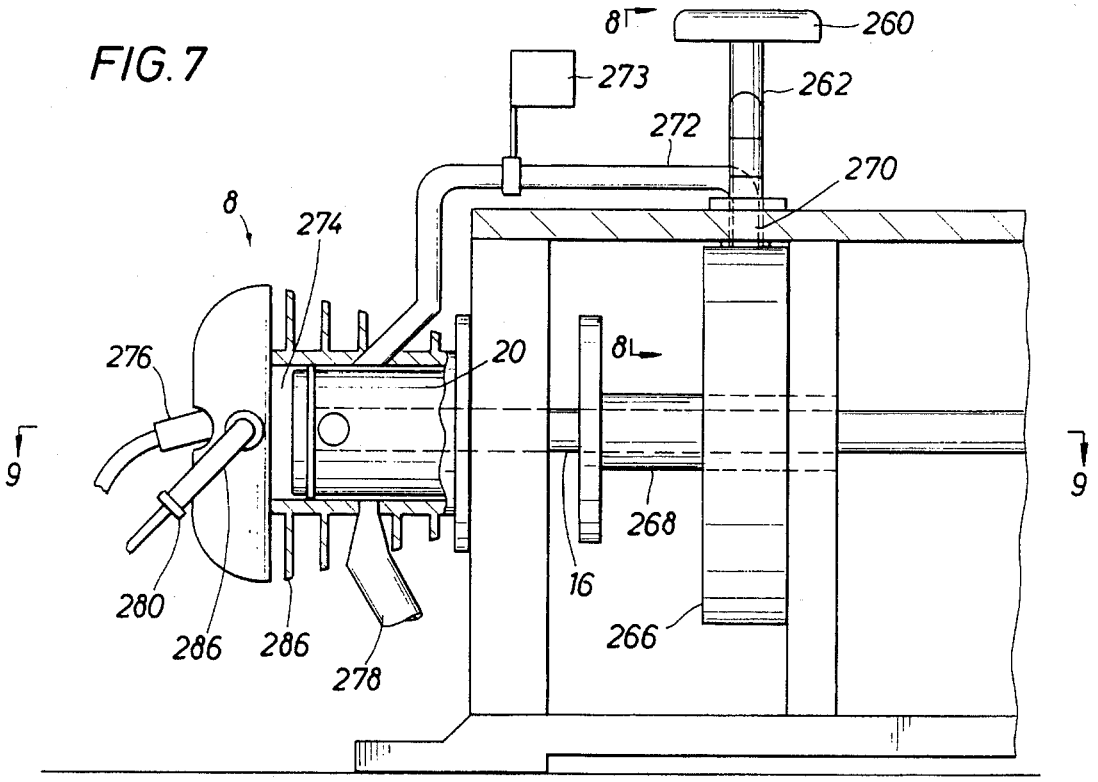
FIG. 7 is an alternate embodiment having a two stroke, gasoline powered engine with an intake, compression, power, and exhaust cycle in the left cylinder and a lubricated crankcase cavity supports an air bellows to aspirate the power cylinder.
Figure 8:
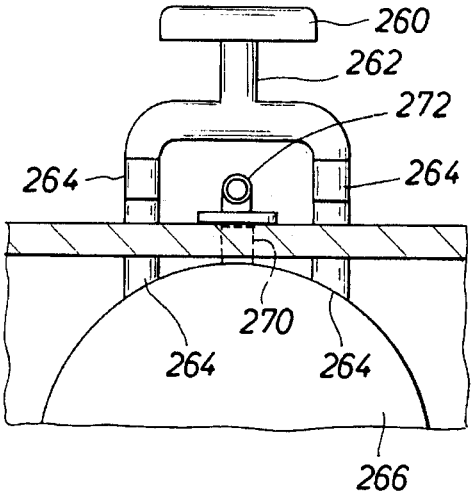
FIG. 8 is a detail view of a valving system for the bellows having two intake check valves and one exhaust check valve.
Figure 9:
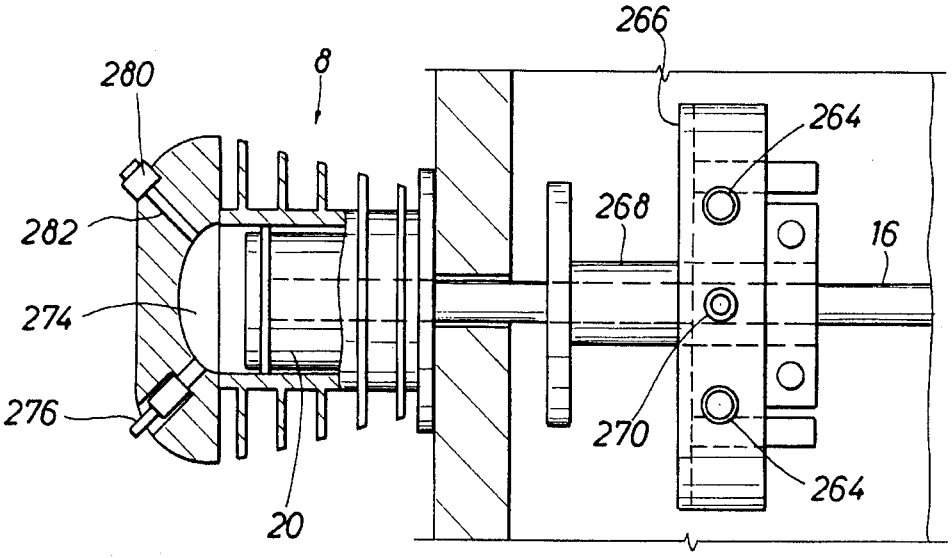
FIG. 9 is a sectional view taken along the line 9—9 of FIG. 7.

The embodiment of the power unit 8 in shown FIGS. 7–9 is a two stroke, gasoline powered engine. The embodiment in FIG. 7 shows an alternative method of charging the air into the power unit 8. A bellow assembly 266 uses two inlet check valves 264. FIG. 9 shows with more particularly the bellows intake and exhaust valves. Air enters an air filtration unit 260 (FIG. 7), passes into the inlet conduit 262, through one or more inlet check valves 264 and into the bellows 266. As the power piston 20 reciprocates, the connected power rod 16 moves the bellows plunger rod 268. As the bellows rod 268 reciprocates, the bellows 266 expand and contract. As the bellows 266 expand, a vacuum pulls air through one or more inlet check valves 264. The bellows 266 air charging system of FIG. 7 could be used in a diesel two stroke engine as well. Importantly, the fuel is not mixed with the lubricant. The pump is not a mixing chamber for fuel and lubricating oil.

One or more inlet check valves 264 may be necessary. As bellows 266 contracts, an outlet check valve 270 opens while the inlet check valves 264 close. The air is then forced through an outlet conduit 272 into the power unit 8. As in FIGS. 5 and 6, the piston in the cylinder seals the chamber as it reciprocates, thus eliminating the needs for intake valves. The embodiment in FIG. 7 uses a direct cylinder injector for adding fuel to the combustion cavity 274. Spark plug 276 common in gasoline engines, fires the fuel/air mixture forcing the power piston 20 to stroke. As the power piston 20 clears an exhaust port 278, the exhaust gases then escape through the exhaust port 278. Incoming air from the bellows 266 aids in purging the chamber of any exhaust gases. Fuel is brought to the combustion chamber 274 by a fuel injector 280 connected to the fuel inlet port 286 in the power unit 8. One advantage of this embodiment (as described in FIGS. 7, 8, and 9) is that no exhaust valves, rocker arms or camshafts are needed. Air flow is controlled by a timing device 273 which preferably is an electrical or pneumatic air flow shutter or butterfly a vacuum opened reed controlling means. Instead of the timed fuel injector 280, a fuel mixing device, such as a carburetor or fuel injector metering unit, can be installed in the outlet conduit 272. As in the embodiments of FIGS. 5 and 6, the crankscase side of power piston 20 is lubricated in a wet sump as is typical of four cycle engines which are known to those knowledgeable in the art. Thus, this two stroke embodiment does not require fuel mixed with lubricating oil, typical of two stroke engines. The embodiment in FIG. 7 is an air cooled engine having heat dissipating surfaces 286, commonly known as fins. Alternatively, a liquid cooled system can be used.

In FIG. 7, the bellows 266 is driven by the rod 268 which passes through the bellows. The rod 268 is best made integral with the rod 16 and has an enlargement in contact with the bellows 266.

Figure 10:
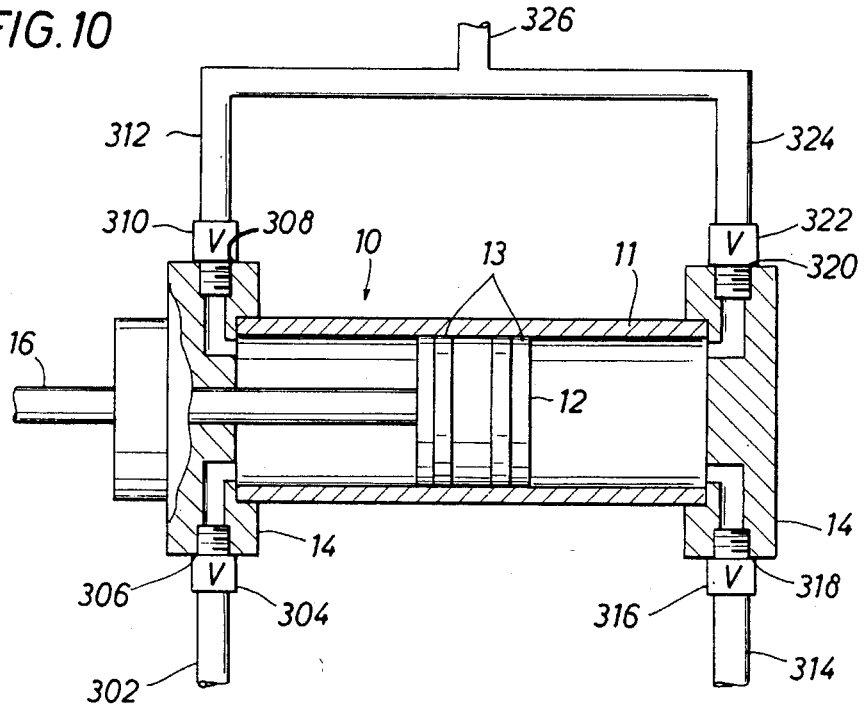
FIG. 10 is an embodiment of the pump unit providing double acting pump configured as a parallel pump having two chambers.

FIG. 10 shows an alternative embodiment of the pump 10. This embodiment is a dual action pump having two inlets and two outlets in parallel with each other. Fluid, whether liquid or gas, enters inlet conduit 302, passes through inlet check valve 304 attached to inlet port 306 in the head 14, whereupon the fluid enters pump 10 and is pressurized through the reciprocating motion of the power piston rod 16. As the piston 12 pressurizes the fluid, the inlet check valve 304 closes and outlet check valve 310 opens. Thus, the pressurized fluid is discharged through outlet 308 through the outlet check valve 310 and into an outlet conduit 312. On the reverse stroke, the fluid on the other side of the piston 12 is pressurized. When the fluid is discharging through the outlet conduit 312, additional fluid is entering through an inlet 314 which passes through an inlet check valve 316 attached to an inlet port 318 with head 14. Upon pressurization while inlet check valves 316 is closed, the fluid is discharged through an outlet port 320, through open exhaust check valve 322, and into outlet conduit 324. Thus, the double acting pump operates in parallel in that flow from the outlet conduit 312 is joined with flow from the outlet conduit 324 into a common exhaust conduit 326. Similarly, the inlet conduit 302 and inlet conduit 314 can connect to the common inlet Conduit 300. Alternatively, the inlet and outlet fluids can be separated and feed from different fluid supplies and exhaust to different fluid supplies.

Figure 11:
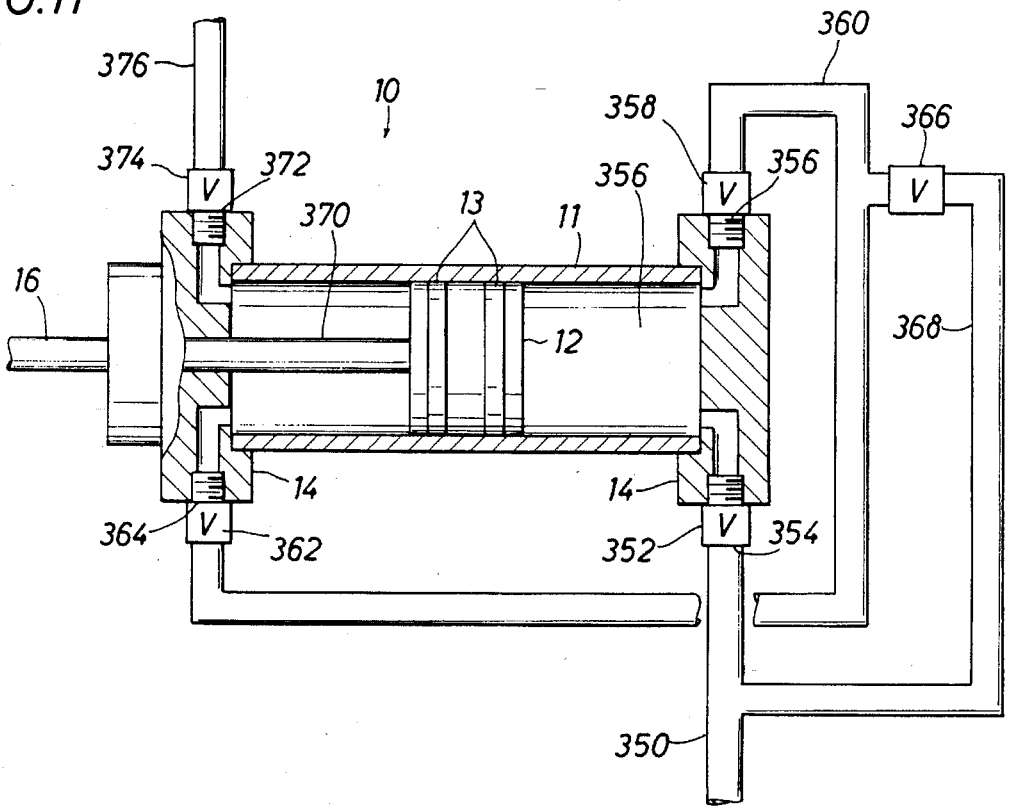
FIG. 11 is an alternate embodiment of a double acting configured in a series circuit wherein the first stage discharges the second stage inlet.

FIG. 11 shows another embodiment of the pump 10. The circuit is a series circuit that compresses the fluid twice. Fluid enters an inlet conduit 350, passes through an open inlet check valve 352 into an inlet port 354 in the head 14. The fluid then fills the chamber 356 formed by the cylinder wall 11, head 14, and piston 12. As the piston 12 reciprocates by the rod 16, the fluid is pressurized. As the fluid is pressurized while inlet check valve 352 is closed, and the fluid is discharged through an outlet port 356 through an open exhaust check valve 358 and into an exhaust conduit 360. The fluid in exhaust conduit 360 then travels through open an inlet check valve 362 attached to inlet port 364. Because the volume per stroke is less on the rod 16 side of piston 12, the volume of fluid required to fill this side of the pump is smaller. Therefore, excess volume (if any) will pass through the valve 366, typically a relief valve, attached to outlet conduit 360. The fluid passing through relief valve 366 will then exit relief conduit 368 which supplements the inlet flow at inlet conduit 350.

After the fluid has entered the inlet port 364 and inlet check valve 362 closes, the reciprocating motion of the piston 12 begins pressurizing the fluid. The fluid then is discharged through an exit port 372 and flows through open exhaust port 374 into an exhaust conduit 376. Because this circuit is arranged in a series type circuit, the pressurized fluid from exhaust port 356 then is directed to the inlet 364, where pressure is then increased. The exhaust port 372 delivers higher pressure than the circuit of FIG. 10.

Figure 12:
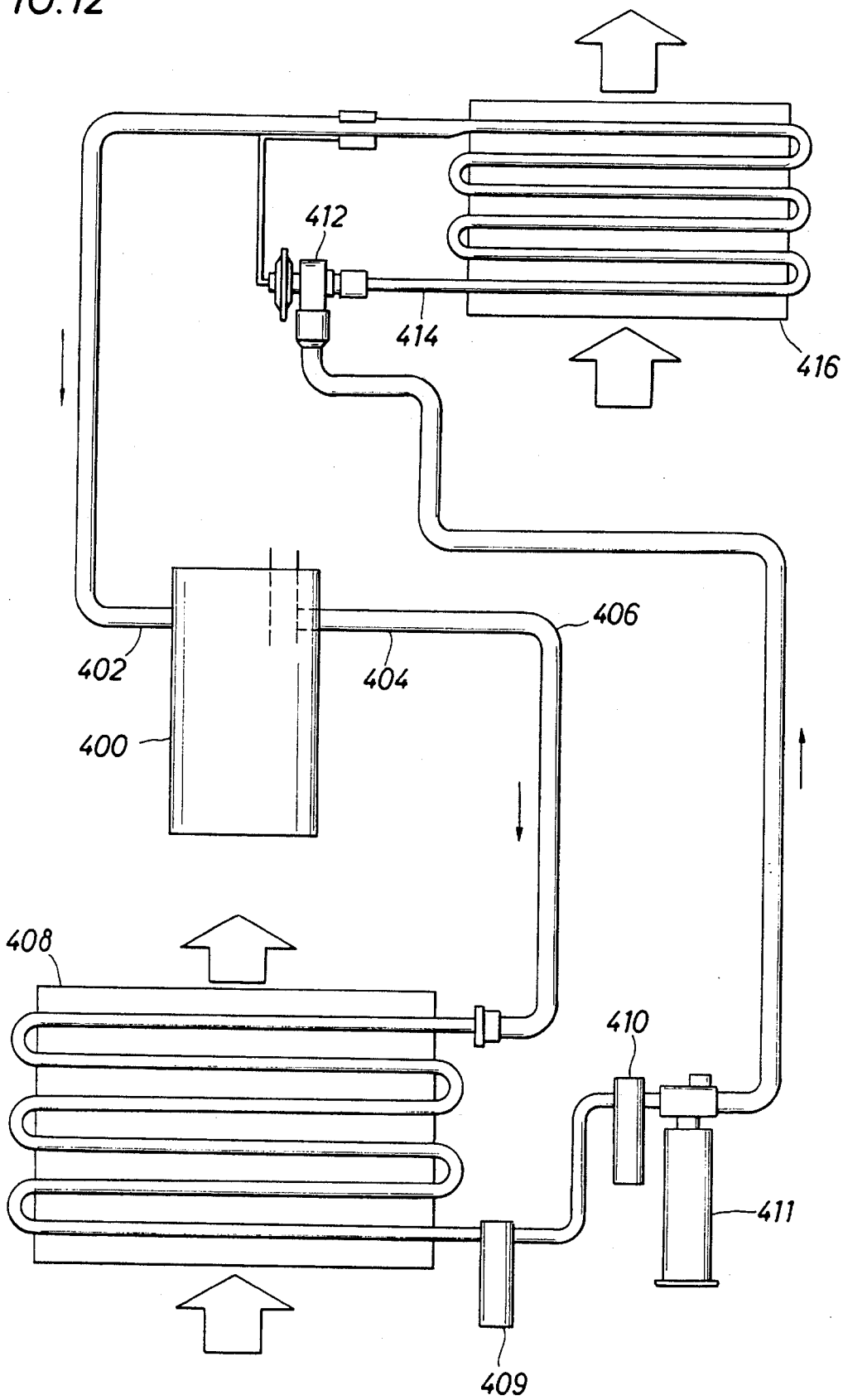
FIG. 12 shows a refrigeration cycle using the pump of the present invention.

The present invention can be used as a refrigeration compressor. FIG. 12 shows a typical refrigeration system, familiar to those knowledgeable in the art. A compressor 400 compresses the gases from inlet 402 into a liquid and discharges the liquid through an exit port 404 into high pressure line 406 at an elevated temperature. The high pressure line 406 enters condenser 408, which is a heat exchanger. By circulating air through the condenser 408, the temperature of the fluid contained in lines 406 is reduced. Upon exiting condenser 408, the fluid then passes through a receiver 409, a filter 410, and a drier 411. After passing through the drier 411, the liquid passes through an expansion valve 412. The expansion valve enables heat to change fluid from a liquid to a gas. The change in fluid state reduces the temperature of the fluid. The gas enters a lower pressure line 414 which passes through a second heat exchanger 416, commonly known as an evaporator coil. When some secondary refrigerant like air or water enters the heat exchanger 416, it becomes refrigerated. As a result, the gaseous fluid in line 414 becomes warmer and is returned to compressor 400 at inlet 402.

Figure 13:
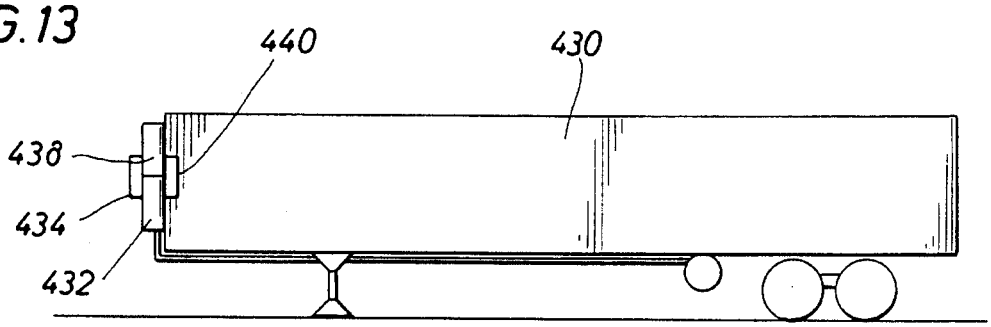
FIG. 13 is a refrigeration trailer for transporting perishable foodstuffs using the refrigeration system of FIG. 12.

The present invention is suitable for use as compressor 400. A typical application of its utility can be seen in FIG. 13. Trailer 430 is a common refrigerated trailer that is used to transport perishable items on highways. It is commonly connected to a tractor and is known as an "18-wheeler." The refrigeration assembly 432 incorporates the various components illustrated in FIG. 12. The present invention offers a light weight, self-contained power unit that can meet the needs of this application.

There are several advantages to the described invention with its various embodiments. First, it provides means for simplifying the power transfer from a power unit to a power using pump. Typically, internal combustion engines require crankshafts, external gears, sprockets, torque converters, external linkages, etc. that are connected to a corresponding linkage, shaft, sprocket, or pulley on a hydraulic cylinder, gear box or other similar unit, which itself contains shafts, bearings, impellers, pumps, valves, and other parts commonly used to those knowledgeable in the art. The present invention simplifies the entire structure. It provides direct power from the power piston 20 to the pump piston 12 through the power rod 16. A minimum of counter balancing and timing rods and bearings are included. System simplicity results in reduced maintenance. Maintenance is also simplified. The system is less expensive unit to manufacture. The weight is reduced because the number of parts is reduced and the parts can be made of light weight alloys or even composites. For instance, the stresses on the power rod 16 are mainly axial. Thus, the tensile and compressive loads are simplified. The bending stresses that normally occur with the rotating and axial loading of power units common in the art are eliminated in the present invention. Thus, light weight materials, small diameter rods, and even hollow tubes can be used. Likewise, the power rod 16 can be made of light weight alloys and composites for the same reasons in that the loads are axial. This weight reduction can be extremely important in applications using the present invention, where weight is considered, such as light weight equipment, automobile vehicles and aircraft. Thus, weight is reduced by the reduction in parts, and also because the nature and manner by which the power is transferred from the power unit 8 to the pump 10.

This application can be used on numerous applications requiring a power unit and a pump. This includes industrial application, automotive applications, aerospace applications, portable power units, and military applications, among others. Thus, while the illustrative embodiments of the invention have been described with particularity, it will be understood that variations and modifications will be apparent and can be readily made by those in the art without departing from the spirit and scope of the invention.

What is claimed is:

1. A powered pump system comprising:

a) a power end having
   1) a fluid-isolated cylinder with,
   2) a cylinder head,
   3) an axially directed power piston in said cylinder defining a combustion chamber in said cylinder between said cylinder head and said power piston, and
   4) air/fuel mixing means connected to deliver a mixture of air/fuel into said combustion chamber for timed ignition to provide power to said power piston moving said power piston with a power stroke;

b) a pump end having
   1) a fluid isolated pump cylinder with
   2) a pump cylinder head,
   3) an axially directed pump piston in said pump cylinder defining a pumped chamber between said pump cylinder head and said pump piston, and
   4) inlet and outlet passage means connected to said pumped chamber to enable pumped fluid to flow there through;

c) an elongate straight rod having two spaced ends wherein said rod at one end is connected to said power piston and the second end is connected to said pump piston wherein said rod delivers an axial power stroke to said pump piston, and wherein said rod is connected to said pump piston and said power piston to preclude rod movement other than axial sliding movement so that said pump piston and rod piston are jointly axially aligned with said rod and said rod is connected to said pistons without rod flexure or deflection; and d) a closed shell interposed between said power end and said pump end wherein said closed shell encloses said straight rod and a lubrication system for said rod, and said closed shell is constructed and arranged to isolate said power end from said pump end.

2. The apparatus of claim 1 wherein said rod has sufficient length to interconnect between said power end and said pump end, and said rod length enables positioning of said pump end at a location remote from said power end and said closed shell includes bearings therein for said rod and lubrication for said rod.

3. The apparatus of claim 1 wherein said power end comprises a two cycle engine having a valve means for cooperatively timing an air/fuel mixture for operation of said two cycle engine.

4. The apparatus of claim 1 wherein said power end comprises a diesel engine having a two cycle operation.

5. The apparatus of claim 1 wherein said power end comprises a diesel engine having a four cycle operation.

6. The apparatus of claim 1 wherein said power end comprises a portion of a multi-cylinder internal combustion engine, and said internal combustion engine is constructed and arranged to incorporate plural straight rods connected with a like number of power ends and pump ends.

7. The apparatus of claim 1 wherein said straight rod is constructed with a central portion having a connective pin enabling a timed means to operate in conjunction with said straight rod to provide timing for ignition of said power end.

8. The apparatus of claim 1 wherein said pump end incorporates a second cylinder head to define a second pumped chamber.

9. The apparatus of claim 8 wherein said pump end incorporates valves and conduits which are constructed and arranged to connect said first and second pumped chambers serially.

10. The apparatus of claim 8 wherein said pump end incorporates valves and conduits which are constructed and arranged to connect said first and second pumped chambers in parallel.

11. A powered pump system comprising:

a) a fluid isolated power end having
   1) a cylinder with
   2) a cylinder head,
   3) a power piston in said cylinder defining a combustion chamber in said cylinder between said cylinder head and said power piston, and
   4) air/fuel mixing means connected to deliver a mixture of air/fuel into said combustion chamber for timed ignition to provide power to said power piston moving said power piston with a power stroke;

b) a fluid isolated pump end having
   1) a pump cylinder with
   2) a pump cylinder head,
   3) a pump piston in said pump cylinder defining a pumped chamber between said pump cylinder head and said pump piston, and
   4) inlet and outlet passage means connected to said pumped chamber to enable pumped fluid to flow there through;

c) an elongate straight rod having two spaced ends wherein said rod at one end is connected to said power piston and the second end is connected to said pump piston wherein said rod delivers power to said pump piston;

d) a supportive frame for aligning said power end, pump end and rod for axial movement only during operation: and e) a closed shell interposed between said power end and said pump end wherein said closed shell encloses said straight rod and a lubrication system for said rod and said closed shell is a sealed chamber.

12. The apparatus of claim 11 wherein said straight rod is constructed with a central portion having a connective pin enabling a timed means to operate in conjunction with said straight rod to provide timing for ignition of said power end.

13. The apparatus of claim 11 wherein said straight rod is constructed with a central portion having a connective pin enabling a timed means to operate in conjunction with said straight rod to provide timing for valve operation of said power end.

14. The apparatus of claim 11 wherein said straight rod is constructed with a central portion having a connective pin enabling timing means to operate in conjunction with said straight rod.

15. The apparatus of claim 11 wherein said pump end incorporates a second cylinder head to define a second pumped chamber.

16. The apparatus of claim 15 wherein said pump end incorporates valves and conduits which are constructed and arranged to connect said first and second pumped chambers serially.

17. The apparatus of claim 15 wherein said pump end incorporates valves and conduits which are constructed and arranged to connect said first and second pumped chambers in parallel.

18. In a powered pumping system having at least one power end piston connected with at least one pump end piston, a system comprising:

a) a power end piston; a pump end piston; and an elongate connecting rod therebetween;

b) a power end chamber surrounding said power end piston wherein combustion occurs therein to create a power stroke applied to said connecting rod;

c) a pump end chamber surrounding said pump end piston; and d) a closed shell surrounding said connecting rod at the central portion thereof, wherein said connecting rod is supported and lubricated for axial reciprocation between said power end piston to said pump end piston.

* * * * *